US007427225B2

(12) United States Patent
Matsukawa et al.

(10) Patent No.: US 7,427,225 B2
(45) Date of Patent: Sep. 23, 2008

(54) REMOTE CONTROL TOY TOP

(75) Inventors: Hiroyuki Matsukawa, Tokyo (JP); Tatsuya Hocho, Tokyo (JP); Jinsei Choh, Chiba (JP); Jintei Choh, Chiba (JP)

(73) Assignees: Tomy Company, Ltd., Tokyo (JP); Xenoid Protodesign Co., Ltd., Chiba (JP)

( * ) Notice: Subject to any disclaimer, the term of this patent is extended or adjusted under 35 U.S.C. 154(b) by 187 days.

(21) Appl. No.: 11/017,302

(22) Filed: Dec. 20, 2004

(65) Prior Publication Data

US 2005/0142983 A1 Jun. 30, 2005

(30) Foreign Application Priority Data

Dec. 25, 2003 (JP) ..... 2003-431157

(51) Int. Cl.
*A63H 1/06* (2006.01)
*A63H 1/00* (2006.01)

(52) U.S. Cl. ..... 446/256; 446/259

(58) Field of Classification Search ..... 446/256–264, 446/454, 456, 175, 355, 233, 234
See application file for complete search history.

(56) References Cited

U.S. PATENT DOCUMENTS

| | | | |
|---|---|---|---|
| 1,856,514 | A | 5/1932 | Sheneman |
| 2,832,177 | A | 4/1958 | Mueller |
| 3,224,142 | A | 12/1965 | Pawelka et al. |
| 3,246,427 | A | 4/1966 | Tuuri |
| 3,253,365 | A | 5/1966 | Calderon |
| 3,254,446 | A | 6/1966 | Endris |
| 3,623,262 | A | 11/1971 | Noda |
| 3,629,680 | A | 12/1971 | Baynes et al. |
| 3,970,309 | A | 7/1976 | Sato |
| 4,090,715 | A | 5/1978 | Wagner et al. |
| 4,636,178 | A | 1/1987 | Oda |
| 4,697,133 | A | 9/1987 | Pergandis |

(Continued)

FOREIGN PATENT DOCUMENTS

| | | | |
|---|---|---|---|
| GB | 2 371 496 | A | 7/2002 |

(Continued)

OTHER PUBLICATIONS

Yahoo! Shopping, Internet: shopping.yahoo.com. battle top, 2003.

(Continued)

*Primary Examiner*—Kien T Nguyen
(74) *Attorney, Agent, or Firm*—Staas & Halsey LLP

(57) ABSTRACT

A toy actuation device is disclosed which has a device body comprising a holding unit that holds a toy such as a stuffed toy. The holding unit including first detecting unit for detecting that the toy is held in the holding unit; and movable engagement members that are engageable with outer parts of the toy. An actuation mechanism actuates the engagement members. A user-holdable member is detachably disposed at the device body and includes a second detecting unit for sensing that the user is holding the user-holdable member in association with the toy; and a control unit that actuates the actuation mechanism on the basis of the detection results of the first detecting unit and the second detecting unit.

6 Claims, 7 Drawing Sheets

U.S. PATENT DOCUMENTS

| | | | | |
|---|---|---|---|---|
| 5,024,625 | A | 6/1991 | MacCarthy | |
| 5,334,075 | A | 8/1994 | Kakizaki et al. | |
| 5,593,338 | A | 1/1997 | Itoh et al. | |
| 5,823,845 | A * | 10/1998 | O'Berrigan | 446/234 |
| 6,089,946 | A | 7/2000 | Yang | |
| 6,458,008 | B1 | 10/2002 | Hyneman | |
| 6,746,300 | B1 | 6/2004 | Matsukawa | |
| 2003/0040255 | A1 | 2/2003 | Hauptner et al. | |
| 2003/0199222 | A1 * | 10/2003 | Matsukawa et al. | 446/256 |

FOREIGN PATENT DOCUMENTS

| | | | |
|---|---|---|---|
| JP | 2-2962 | | 1/1990 |
| JP | 9038337 | A | 2/1997 |
| JP | 10076074 | A | 3/1998 |
| JP | 2002-962 | | 1/2002 |
| JP | 2002-000962 | A | 3/2002 |
| JP | 2003-305282 | | 10/2003 |
| KR | 2002020561 | A | 3/2002 |

OTHER PUBLICATIONS

Hasbro, Internet: www.hasbro.com, press release, "Beyblade tops, the number-one, authentic high-performance tops, spin to the line in 2003", 2003.

Funkyzilla, Internet: www.funkyzilla.com, "Remote Controlled Beyblade Dragoon", 2003.

Hasbro, Internet: www.hasbro.com, "Beyblade Products", 2003.

* cited by examiner (a)

(b)

REMOTE CONTROL TOY TOP

BACKGROUND OF THE INVENTION

1. Field of the Invention

The present invention relates generally to a remote control toy top, and more particularly to a remote control toy top whose operating characteristics can be changed by remote control as the toy top is spinning.

2. Description of the Related Art

Conventionally, playing with toy tops, where plural toy tops are spun on a game board and made to fight by bumping into each other, has become popular among many users. The spinning characteristics of the toy tops can be changed by recombining the parts configuring the toy tops. However, the spinning characteristics are set before the toy tops are spun, and cannot be changed once the toy tops are spinning. With respect thereto, a toy top has been proposed where the spinning characteristics of the toy top can be changed at will by the user while the toy top is spinning (e.g., Japanese Patent Application Laid-Open Publication (JP-A) No. 2002-962).

The toy top disclosed in JP-A No. 2002-962 is disposed with two blades that are kept from opening by a swinging arm when the toy top is initially operated. When a signal causing the blades to open is transmitted to the toy top while the toy top is spinning, the swinging arm swings and the blades open in conjunction with the swinging of the swinging arm, whereby the spinning characteristics of the toy top can be changed while the toy top is spinning.

However, this conventional toy top has a drawback in that the spinning characteristics cannot be further changed once they have been changed, so that the spinning characteristics cannot be repeatedly changed.

SUMMARY OF THE INVENTION

It is therefore the object of the present invention to solve this problem by providing a remote control toy top whose spinning characteristics can be freely controlled as the toy top spins, whose operating mode can be freely changed, and in the operation of which a player can repeatedly intervene.

In order to achieve the above object, a first aspect of the present invention provides a remote control toy top comprising the combination of a toy top and a remote controller device that changes the operating mode of the toy top by remote control, wherein the toy top includes a toy top body provided with a motor whose forward and reverse rotational directions and rotational speed are controlled by control signals transmitted from the remote controller device, and wherein the toy top includes a rotating shaft body that is rotatably supported at a bottom portion of the toy top body, the rotating shaft body rotating in conjunction with a motor shaft of the motor.

In a second aspect of the invention, the remote controller device comprises a rotation-instructing operational unit that instructs that forward and reverse rotation of the motor be conducted; and a change-instructing operational unit that instructs that a change of the rotational speed of the motor be conducted, the motor being rotated at a low speed when the rotation-instructing operational unit is operated, the motor being rotated at a high speed when the change-instructing operational unit is operated together with the rotation-instructing operational unit.

According to the first aspect of the invention, the rotating shaft body of the toy top is disposed at the motor shaft of the motor disposed inside the toy top, the will of a player can be reflected in the operating mode of the toy top by remotely controlling the forward and reverse rotational directions and the rotational speed of the motor with the remote controller device, and the player can thus enjoy playing with the toy top in a strategic manner that could not be enjoyed with a conventional toy top where the player simply looks on while attacks on and defense against an opponent's toy top were left to chance.

According to the second aspect of the invention, the remote controller device comprises the rotation-instructing operational unit that instructs that forward and reverse rotation of the motor be conducted and the change-instructing operational unit that instructs that a change of the rotational speed of the motor be conducted. Forward and reverse rotations of the motor at a low speed and forward and reverse rotations of the motor at a high speed can be controlled by the rotation-instructing operational unit and the change-instructing operational unit, so that changes in the operation mode of the toy top can be freely controlled by simple operations.

BRIEF DESCRIPTION OF THE DRAWINGS

The above and other objects, aspects, features and advantages of the present invention will become more apparent from the following detailed description when taken in conjunction with the accompanying drawings, in which.

DESCRIPTION OF THE PREFERRED EMBODIMENT

A remote control toy top of the invention is configured by a toy top and a remote controller device that changes the operating mode of the toy top by remote control. A rotating shaft body of the toy top is rotatable supported at a toy top body and rotates in conjunction with a motor. The motor is configured so that the forward and reverse rotational directions and the rotational speed of the motor are controlled by control signals transmitted from the remote controller device, so that the rotation of the rotating shaft body of the toy top can be controlled by the remote controller device.

Figure 1:
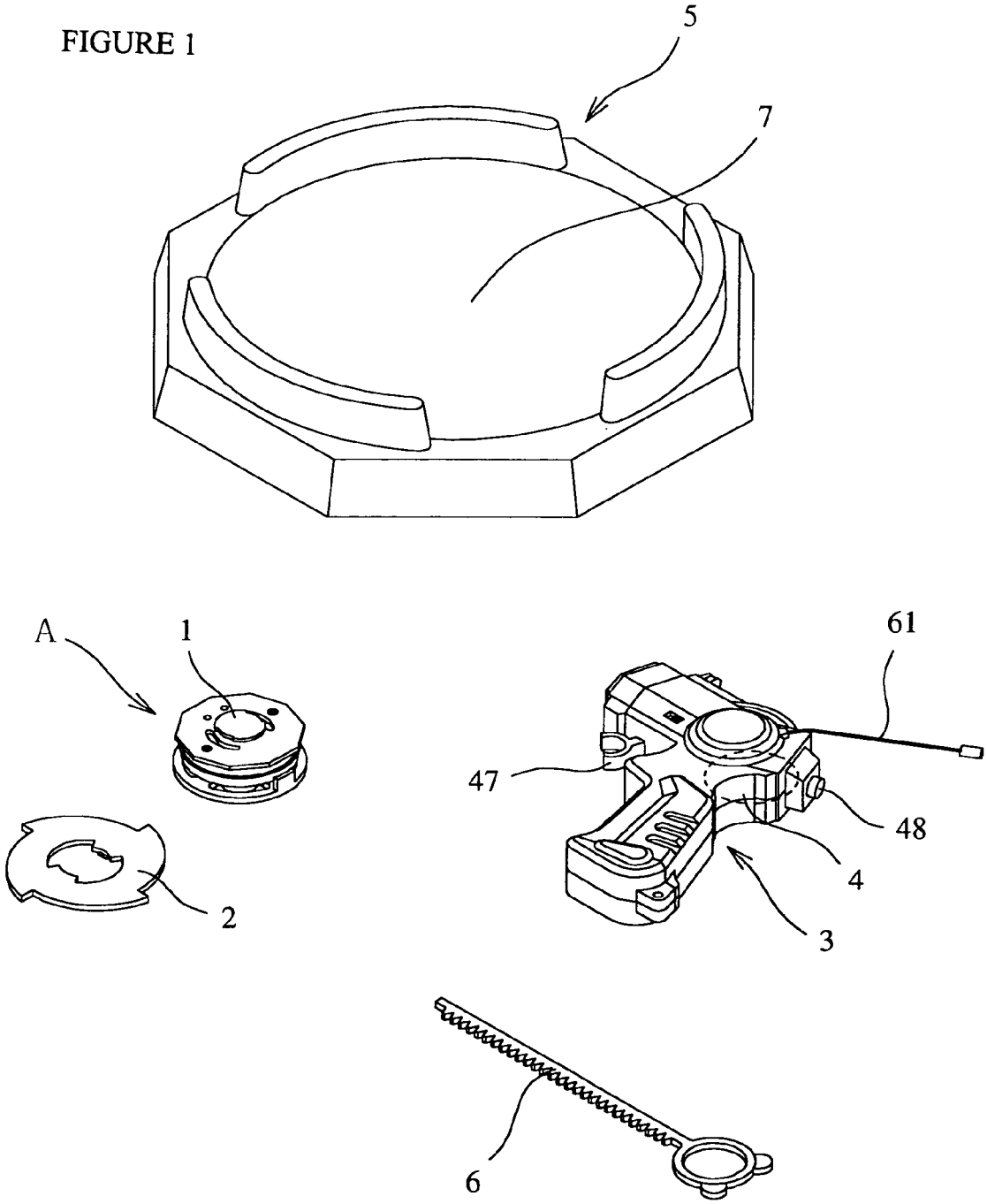
FIG. 1 is a perspective view describing the configuration of a remote control toy top pertaining to the present invention.

FIG. 1 shows an example of a toy top A pertaining to the invention. The toy top A includes a toy top body 1 and an attack-use ring 2 attached to the toy top body 1. The toy top A is spun on a game board 5 by using a starter mechanism 4 disposed in a remote controller device 3 to impart a spin to the toy top A, so that the toy top A can compete with other toy tops.

In FIG. 1, reference numeral 6 represents a rack belt that actuates the starter mechanism 4.

The game board 5 has a game surface 7 that is curved in a convex mirror shape disposed thereon. The game surface 7 is configured so that when the spinning speed of the toy top A is high, the toy top A moves in the outer peripheral direction on the game surface 7 while spinning, and when the spinning speed of the toy top A is low, the toy top A moves towards the center of the game surface 7. Thus, the toy top A can move without stopping at one point and contact other toy tops.

Figure 2:
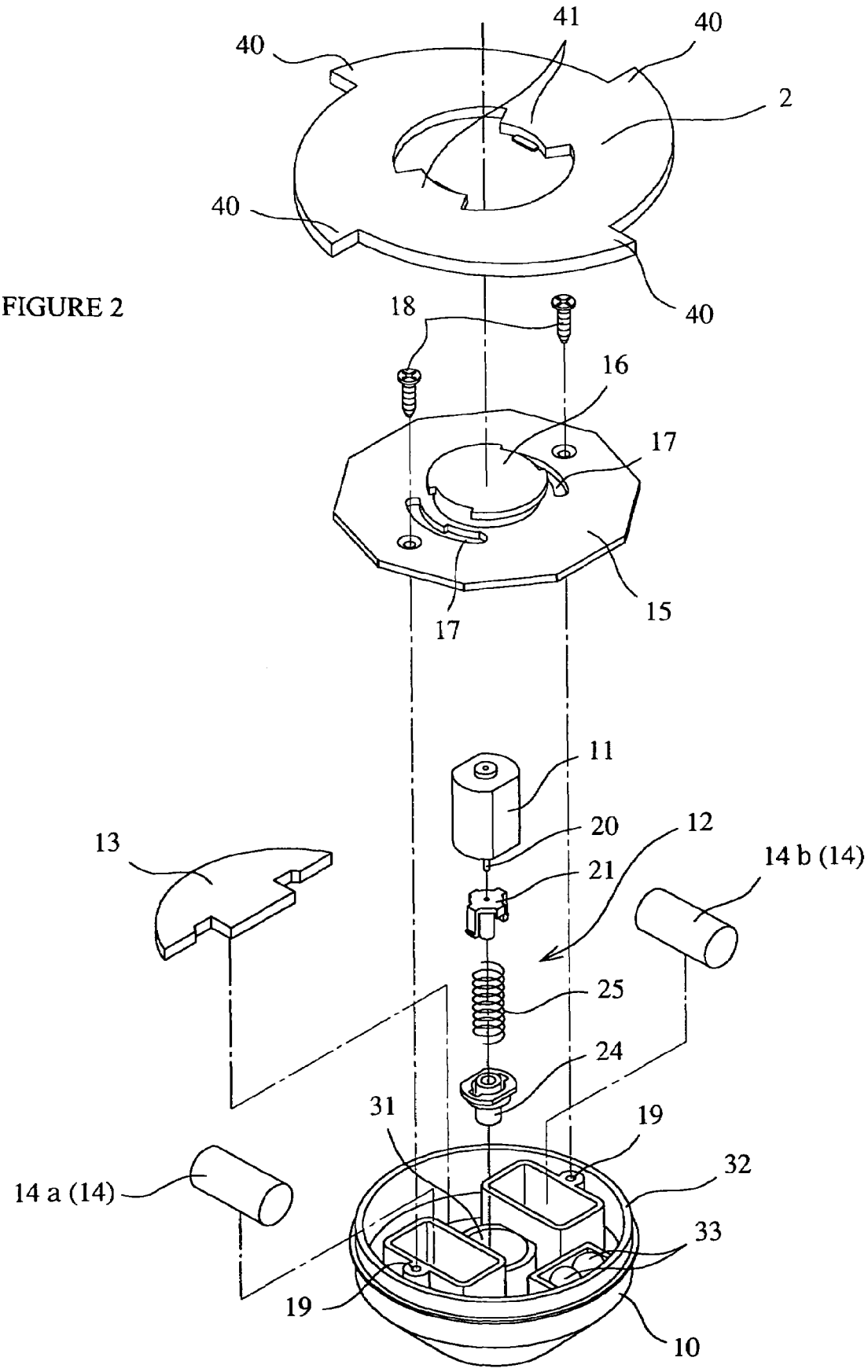
FIG. 2 is an exploded perspective view describing the configuration of the toy top.

As shown in FIG. 2, the toy top body 1 includes a base member 10 disposed with a motor 11, a rotating shaft body 12, a circuit board 13 disposed with a control circuit that controls the rotation of the motor 11, and batteries 14 comprising secondary batteries. A lid 15 is integrally fixed to the base member 10 with screws 18. A mount 16, to which the attack-use ring 2 can be attached and from which it can be detached, is fixed to a top surface of the lid 15.

Figure 3:
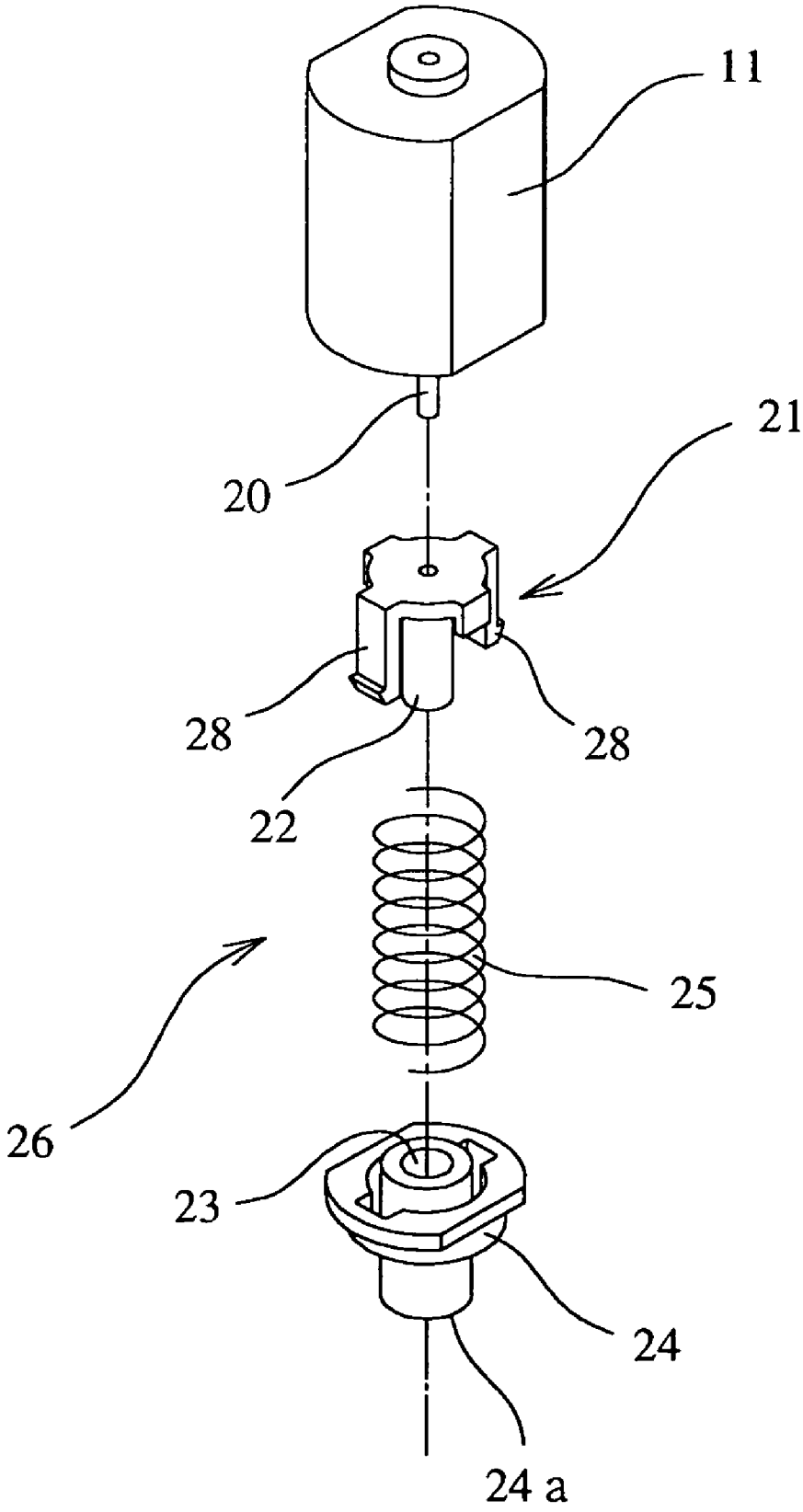
FIG. 3 is an exploded perspective view describing the configuration of a rotating shaft body.

As shown in FIG. 3, the rotating shaft body 12 of the motor 11 is configured by a fixed shaft 21, which is fixed to a motor shaft 20 of the motor 11, and a movable shaft 24, which includes an engagement recess 23 that engages with a shaft portion 22 of the fixed shaft 21 so as to be slidable up and down. The movable shaft 24 is constantly urged downward by a spring 25. A buffer mechanism 26 is configured by the movable shaft 24 and the spring 25 so that when the toy top A is released from the starter mechanism 4 disposed in the remote controller device 3 and falls onto the game surface 7 of the game board 5, the impact thereof is absorbed by the spring 25 and does not directly extend to the motor 11.

Figure 4:
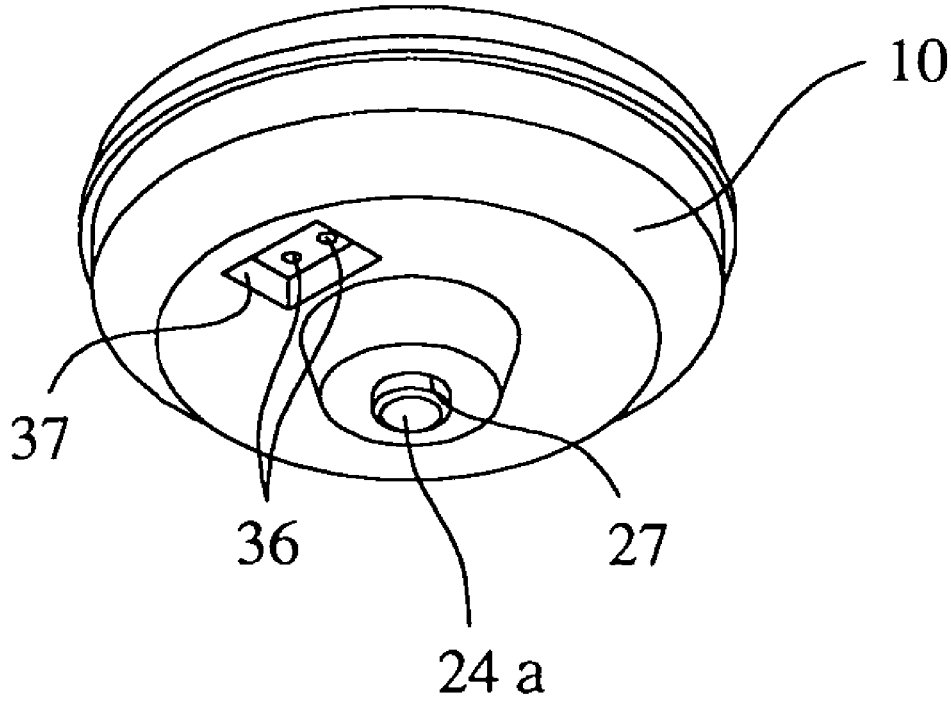
FIG. 4 is a bottom side perspective view of the toy top.

As shown in FIG. 4, a tip end portion 24*a* of the movable shaft 24 projects downward from an opening 27 formed in the bottom surface of the base member 10. The toy top body 1 spins using the tip end portion 24*a* as an axis.

The fixed shaft 21 includes hooks 28 that are formed so as to project downward from both sides of the fixed shaft 21. The hooks 28 are for ensuring that the movable shaft 24 can slide up or down with respect to the fixed shaft 21 without coming off of the fixed shaft 21. The hooks 28 slidably couple together the fixed shaft 21 and the movable shaft 24 in a state where the spring 25 is accommodated therein.

The base member 10 is formed in a thin circular cylinder shape including a top surface that is entirely open and a bottom surface whose center is open. The periphery of the center opening 27 projects upward in a circular cylinder shape to form a housing 31 for the motor 11. The circuit board 13, the batteries 14 (14*a* and 14*b*) configured by secondary batteries (nickel cadmium batteries) and balancers 33 are housed between the housing 31 and an outer wall 32.

A socket 37 disposed with two electrodes 36 is formed in the bottom surface of the base member 10 (see FIG. 4). The electrodes 36 are used when the batteries 14 (14*a* and 14*b*) are charged, and are disposed so that they cannot contact a later-described charging terminal 56 disposed in the remote controller device 3.

The lid 15 is a polygonal or circular discoid member. The mount 16 to which the attack-use ring 2 attaches is fixed to the center of the lid 15. Arced insertion holes 17, into which holding pieces 54 of the starter mechanism 4 are inserted, are formed at symmetrical positions in the lid 15 so that the mount 16 is disposed therebetween.

The lid 15 is fixed to the base member 10 by screwing the flat countersunk head screws 18 into screw holes 19 of the base member 10 in a state where the lid 15 is superposed on the base member 10 and where the circuit board 13, the motor 11 and the batteries 14 are housed in the base member 10.

The attack-use ring 2 is a discoid member that includes a substantially circular opening in the center and flared portions 40 formed at equidistant intervals around the periphery. The flared portions 40 flare outward from the peripheral surface of the attack-use ring 2 and are for attacking toy top opponents. Two flared pieces 41 are formed at opposite sides of an inner side of the opening in the center of the attack-use ring 2. The attack-use ring 2 can be attached to and detached from the mount 16 formed on the lid 15. The structure by which the attack-use ring 2 is attached and detached is publicly known from a prior application for a toy top filed by the present applicant, and the attack-use ring 2 can be attached and detached with a publicly known method.

Figure 5:
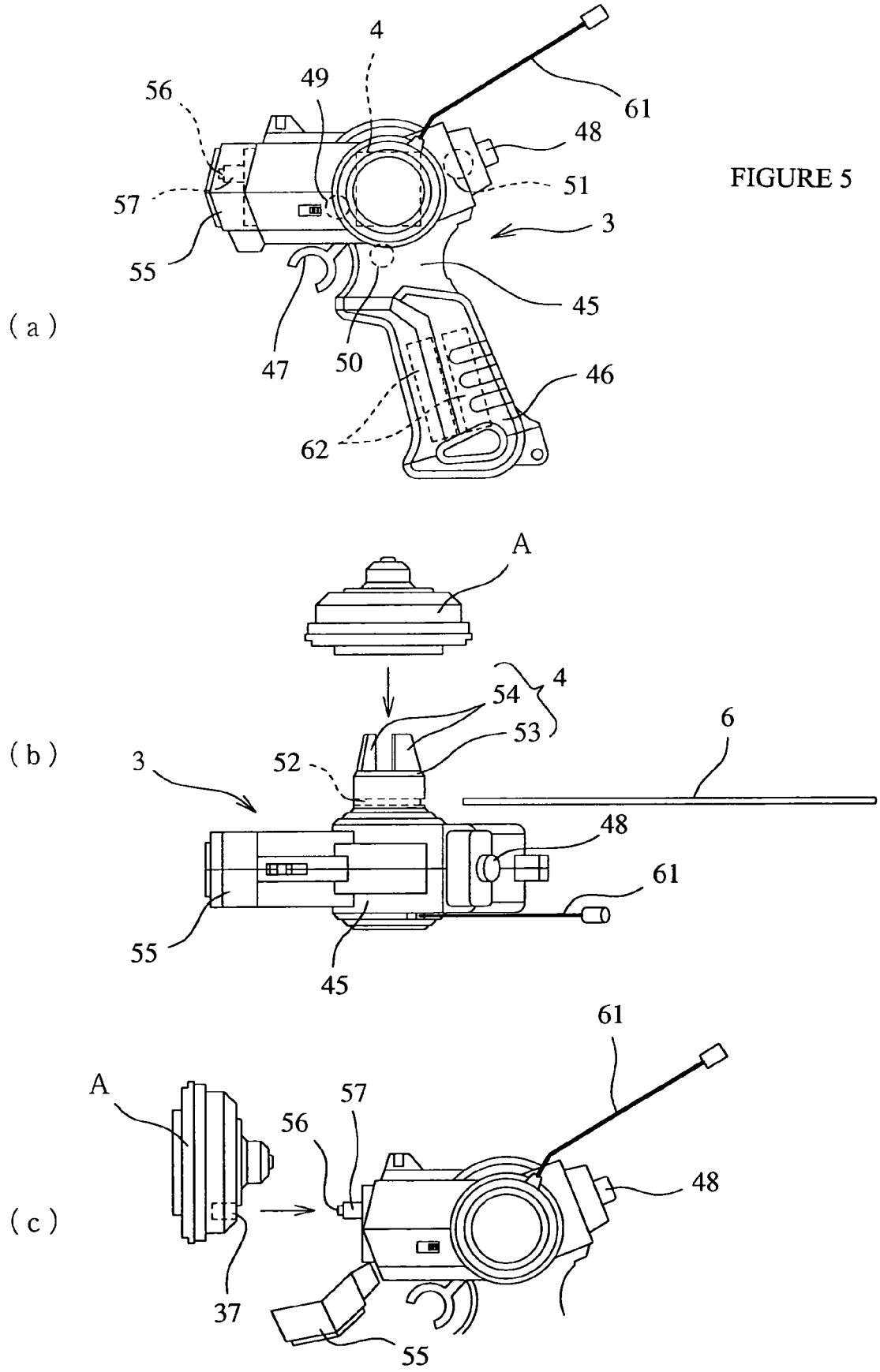
FIGS. 5A to 5C are front and plan views of a remote controller device.

FIGS. 5A and 5B respectively show a front view and a plan view of the remote controller device 3. The remote controller device 3 is formed in a pistol shape disposed with a grip portion 46 so that a device body 45 of the remote controller device 3 can be gripped with one hand. Batteries 62 are housed in the grip portion 46. A trigger-like operational lever 47, which can pivot forwards and backwards, is disposed at an upper portion of the grip portion 46. A pushable push button 48 is disposed at a rear end of the device body 45.

The remote controller device 3 is configured so that when the operational lever 47 is pivoted backward, a switch 49 is switched ON and a control signal R1 that causes the motor 11 to rotate rightward is transmitted, and when the operational lever 47 is pivoted forward, a switch 50 is switched ON and a control signal L1 that causes the motor 11 to rotate leftward is transmitted.

The remote controller device 3 is also configured so that when the push button 48 is pushed, a switch 51 is switched ON, but when the push button 48 is pushed while pivoting the operational lever 47, a control signal R2 or L2 that causes the motor 11 to rotate at a high speed is transmitted.

The starter mechanism 4 that imparts an initial spin to the toy top A is disposed in the remote controller device 3. The starter mechanism 4 may be configured as a publicly known starter mechanism. The starter mechanism 4 is configured so that a gear not shown meshes with the rack belt 6 when the rack belt 6 is inserted through a through-hole 52 that penetrates the right side surface of the device body 45 from front to back. This gear is rotated by pulling the rack belt 6, whereby a rotating plate 53 disposed at a side surface of the device body 45 is rotated at a high speed. When the rack belt 6 is completely pulled out from the device body 45, a ratchet not shown meshes with the gear so that the rotation of the rotating plate 53 is instantaneously stopped.

The two holding pieces 54 that hold the toy top A are formed at the rotating plate 53 so as to project from the rotating plate 53. The toy top A held in the holding pieces 54 can be spun at a high speed by using the rack belt 6 to rotate the rotating plate 53. When the rotating plate 53 suddenly stops, the toy top A continues spinning due to inertia, is released from the holding pieces 54 and spins independently.

As shown in FIG. 5C, a plug 57 disposed with the charging terminal 56 is exposed when a cover 55 at a front side of the device body 45 is opened. By inserting the plug 57 into the socket 37 disposed at the rear side of the toy top A, the charging terminal 56 makes contact with the electrodes 36 so that the batteries 14 of the toy top A can be charged by the batteries 62 of the remote controller device 3.

Figure 6:
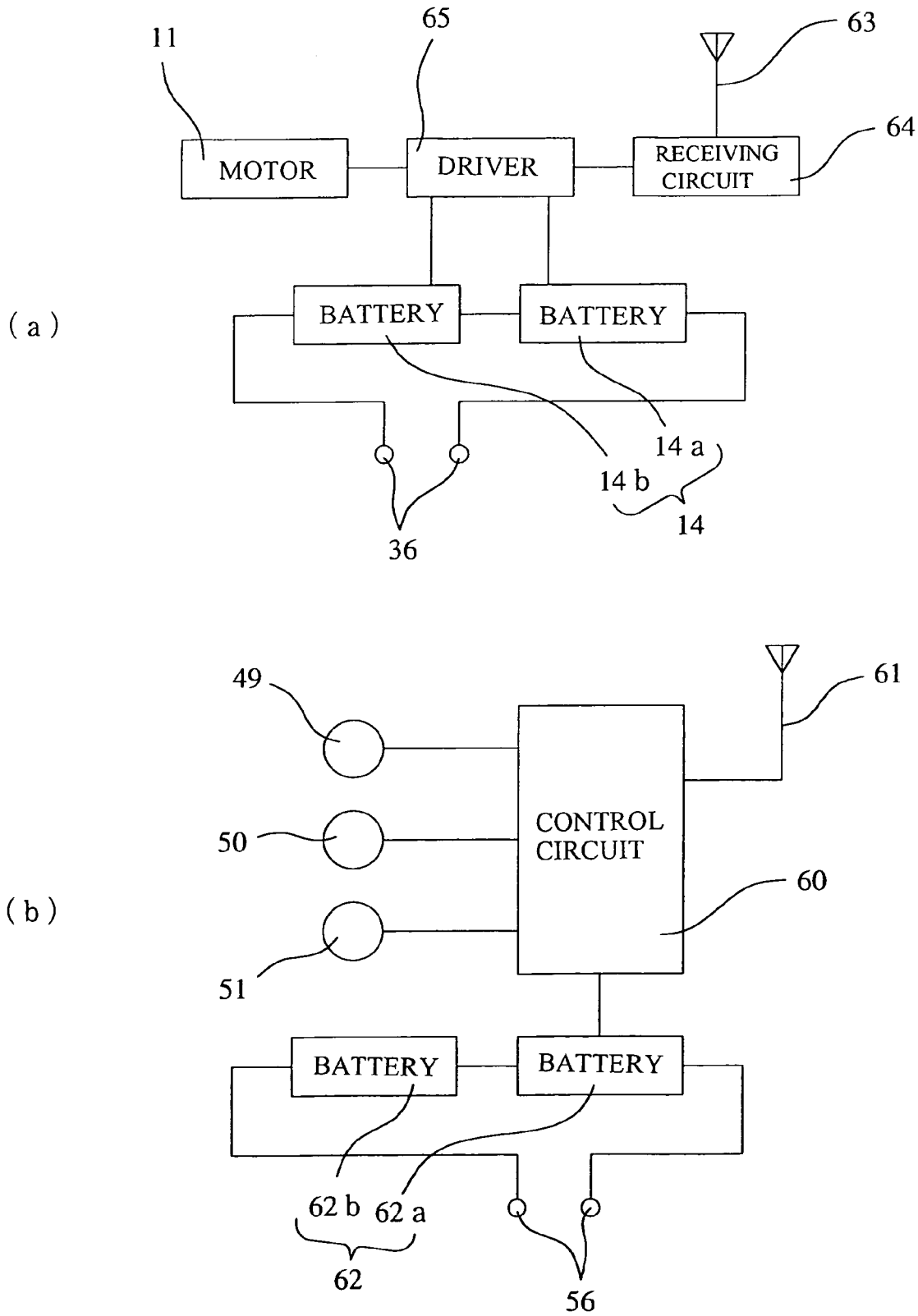
FIGS. 6A and 6B are block diagrams of the toy top and the remote controller device.

FIGS. 6A and 6B show block diagrams describing the concept of the electrical configuration of the toy top A and the remote controller device 3.

In FIG. 6B, reference numeral 60 represents a control circuit that creates and transmits the control signals that remotely control the rotation of the motor 11 of the toy top A. The control signal R1 that causes the motor 11 to forwardly rotate (rightward rotation) at a low speed is created by the switch 49 that is switched ON by pivoting the trigger-like operational lever 47, the control signal L1 that causes the motor 11 to reversely rotate (leftward rotation) at a low speed is created by the switch 50, and the control signals R2 and L2 that cause the motor 11 to rotate at a high speed in a direction designated by the operational lever 47 are created by pushing the push button 48, which is disposed at the rear end of the device body 45, while pivoting the operational lever 47 to switch the switch 51 ON. The created signals R1 to L2 are transmitted to the toy top A from an antenna 61.

The batteries 62 configure an operational power source for the remote controller device 3 and a charging power source that charges the batteries 14 of the toy top A. The control circuit 60 is actuated by only the battery 62*a*, and at the time of charging, the batteries 14 of the toy top A are charged by the batteries 62*a* and 62*b*.

The control signals R1 to L2 transmitted from the remote controller device 3 are received by an antenna 63 of the toy top A and converted by a receiving circuit 64 to signals that control a motor driver 65, so that the forward and reverse rotational directions and the rotational speed of the motor 11 are controlled by the motor driver 65.

When the receiving circuit 64 receives the control signal R1, the receiving circuit 64 controls the driver 65 so that the motor 11 is made to rotate rightward by only the battery 14*a*. When the receiving circuit 64 receives the control signal L1, the receiving circuit 64 controls the driver 65 so that the motor 11 is made to rotate leftward by only the battery 14*a*.

When the receiving circuit 64 receives the control signal R2, the receiving circuit 64 controls the driver 65 so that the batteries 14*a* and 14*b* are serially connected and the motor 11 is made to rotate rightward at a high speed. When the receiving circuit 64 receives the control signal L2, the receiving circuit 64 controls the driver 65 so that the batteries 14*a* and 14*b* are serially connected and the motor 11 is made to rotate leftward at a high speed.

Although a wireless radio controller is used for the transmission and reception of the control signals, an infrared remote controller using an infrared LED at the transmitting side and a light-receiving element (photodiode) at the receiving side in place of the antennas may also be used.

According to the remote control toy top of the above-described configuration, the batteries 14 of the toy top A are charged, then the toy top A is set in the remote controller device 3, the rack belt 6 is inserted into the through-hole 52 of the device body 45, then the right side of the remote controller device 3 is tilted downward so that the toy top A faces the game surface 7 of the game board 5, and the rack belt 6 is then yanked out.

Because the rotating plate 53 rotates at a high speed in concert with the pulling of the rack belt 6, the toy top A held by the holding pieces 54 disposed at the rotating plate 53 spins integrally with the rotating plate 53. The rotating plate 53 stops suddenly when the rack belt 6 is completely pulled out from the through-hole 52 of the device body 45, whereby the toy top A spinning due to inertia is released from the holding pieces 54 as it spins, falls onto the game surface 7 of the game board 5 and continues spinning on the game surface 7.

When the toy top A falls onto the game surface 7, the entire weight of the toy top A is placed on the rotating shaft body 12 and the rotating shaft body 12 receives a large shock, but the coil spring 25 absorbs this shock so that the shock is not directly transmitted to the motor shaft 20 of the motor 11. Thus, trouble such as the motor 11 sustaining damage due to the shock can be prevented in advance.

The toy top A spins on the game surface 7 of the game board 5 curved in a convex mirror shape, but because the tip end portion 24*a* of the movable shaft 24 is flatly formed so that the toy top A stands upright due to a gyro effect, the corners of the tip end portion 24*a* of the movable shaft 24 contact the game surface 7, the peripheral edge of the tip end portion 24*a* of the movable shaft 24 exhibits a function like a small wheel and the toy top A spins and moves (revolves) in an arc on the game surface 7. The higher the number of revolutions, the larger the arc becomes.

Figure 7:
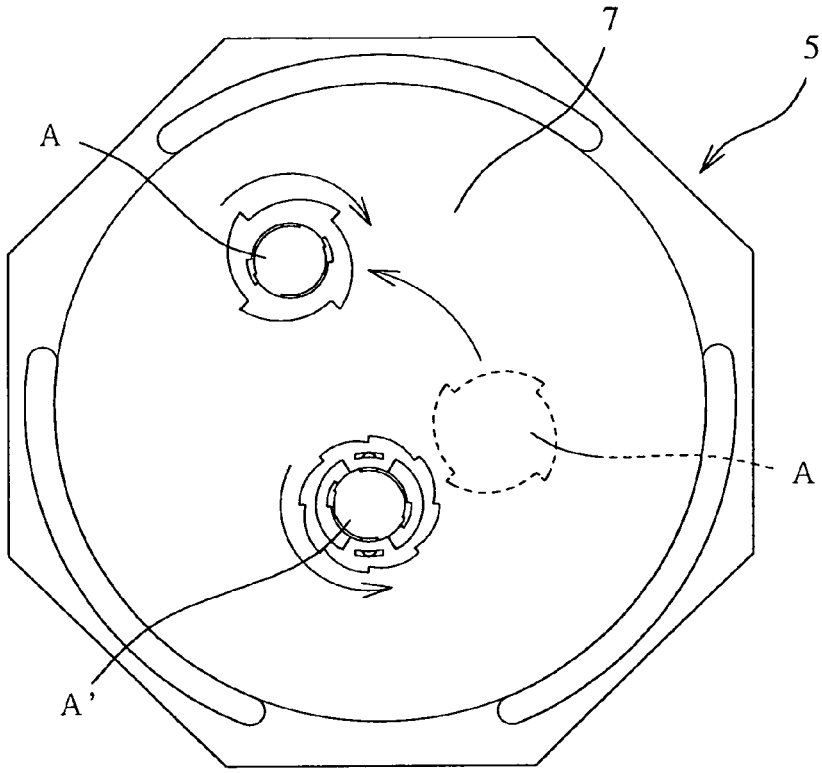
FIGS. 7A and 7B are plan views describing the operating mode of the toy tops spinning on a game board.
Figure 7:
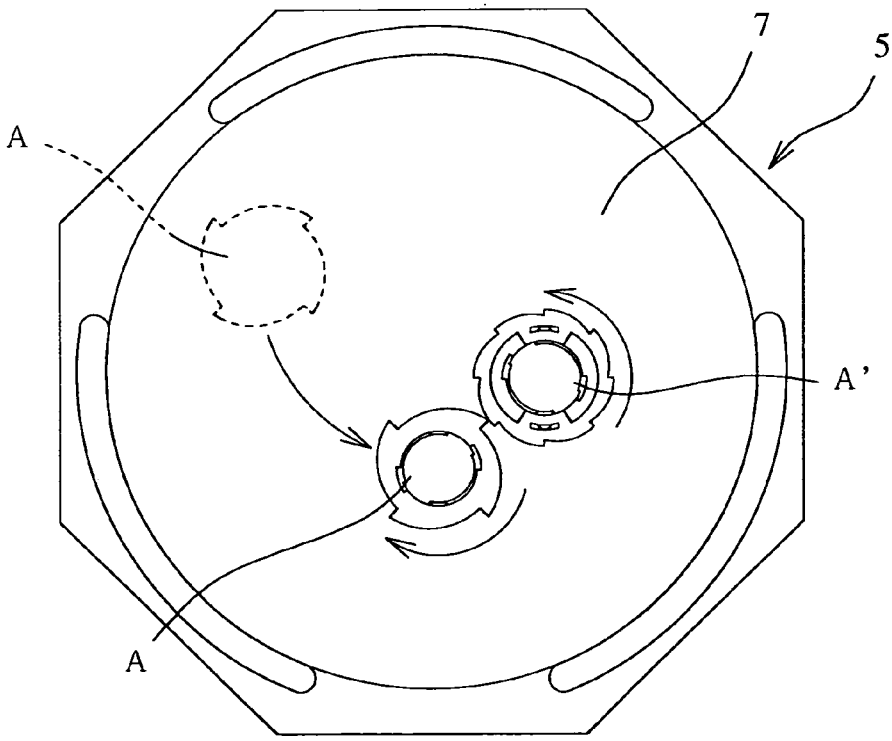

At this time, when the operational lever 47 is pivoted backwards in a case where the initial rotation of the toy top A is a rightward rotation, the switch 49 is switched ON so that the control circuit 60 transmits the control signal R1 that causes the motor 11 to rotate rightward (the rotational direction of the motor 11 is the same as that of the toy top A) during the time that the operational lever 47 is being pivoted. When the receiving circuit 64 of the toy top A receives the control signal R1, the receiving circuit 64 instructs the driver 65 to cause the motor 11 to rotate rightward by only the battery 14*a*, and the driver 65 causes the motor 11 to rotate rightward at a low speed. When the motor 11 rotates rightward, the movable shaft 24 rotates rightward in concert with the motor shaft 20, the rotational speed of the entire toy top A increases, the toy top A revolves and moves faster in a large diameter in a counter-clockwise direction and moves towards the outer side of the game surface 7 (see FIG. 7A).

When the push button 48 is pushed at this time, the switch 51 is switched ON. Thus, the control circuit 60 transmits the control signal R2 causing the motor 11 to rotate rightward at a high speed. When the receiving circuit 64 of the toy top A receives the control signal R2, voltage is applied to the motor 11 in a state where the batteries 14*a* and 14*b* are serially connected and the receiving circuit 64 causes the motor 11 to rotate rightward at a high speed.

When the operational lever 47 is pivoted forward, the switch 50 is switched ON. Thus, the control circuit 60 transmits the control signal L1 causing the motor to rotate leftward (the rotational direction of the motor 11 is the opposite of that of the toy top A) during the time that the operational lever 47 is being pivoted. When the receiving circuit 64 of the toy top A receives the control signal L1, the receiving circuit 64 instructs the driver 65 to cause the motor 11 to rotate leftward by only the battery 14*a*, and the driver 65 causes the motor 11 to rotate leftward at a low speed. When the motor 11 rotates leftward, the movable shaft 24 rotates leftward in concert with the motor shaft 20, the toy top A revolves and moves faster in a small diameter and moves towards the center of the game surface 7 (see FIG. 7B).

Movement stops when the rotational speed of the toy top A and the reverse rotational speed of the rotating shaft body 12 are made the same by pulling the operational lever 47. When the reverse rotational speed of the rotating shaft body 12 is greater than the rotational speed of the toy top A, the toy top A can be made to revolve and move rightward.

When the operational lever 47 is pivoted forward in a case where the initial rotation of the toy top A is a leftward rotation, the control signal L1 that causes the motor 11 to rotate leftward (the rotational direction of the motor 11 is the same as that of the toy top A) is transmitted during the time that the operational lever 47 is being pivoted. Thus, the movable shaft 24 is rotated leftward at a high speed in concert with the motor shaft 20 of the motor 11 to cause the toy top A to revolve in a clockwise direction in a large diameter. When the operational lever 47 is pivoted forward, the control signal R1 that causes the motor 11 to rotate rightward (the rotational direction of the motor 11 is the opposite of that of the toy top A) is transmitted during the time that the operational lever 47 is being pivoted. Thus, the movable shaft 24 is rotated rightward in concert with the fixed shaft 21 of the motor 11, the toy top A revolves and moves in a small diameter and moves towards the center of the game surface 7.

As described above, by controlled the rotation of the movable shaft 24 of the toy top A rotating on the game surface 7 of the game board 5, the toy top A revolving and moving on the game surface 7 can be made to move towards the outer side of the game surface 7 and towards the center of the game surface 7, whereby the operating mode of the toy top A can be changed. Thus, a player can freely control, with his/her own will, the toy top A to avoid an attack by an opponent's toy top A' or to attack the toy top A', so that the player can enjoy play with the toy top A in which the will of the player is reflected. That is, unlike the conventional toy top, where fighting between toy tops on the game surface 7 of the game board 5 is left to chance and thus is not very enjoyable, the toy top of the present invention allows the player to intervene repeatedly in the operation.

While the illustrative and presently preferred embodiment of the present invention has been described in detail herein, it is to be understood that the inventive concepts may be otherwise variously embodied and employed and that the appended claims are intended to be construed to include such variations except insofar as limited by the prior art.

What is claimed is:

1. A remote control toy top comprising the combination of:

a toy top; and a remote controller device that changes the operating mode of the toy top by remote control, wherein the toy top includes a toy top body provided with a motor whose forward and reverse rotational directions and rotational speed are controlled by control signals transmitted from the remote controller device, wherein the toy top includes a rotating shaft body that is rotatably supported at a bottom portion of the toy top body, the rotating shaft body rotating in conjunction with a motor shaft of the motor, wherein the remote controller device includes a rotation-instructing operational unit that instructs forward and reverse rotation of the motor, wherein the remote controller device includes a change-instructing operational unit that instructs change of the rotational speed of the motor, the motor being rotated at a low speed when the rotation-instructing operational unit is operated, the motor being rotated at a high speed when the change-instructing operational unit is operated together with the rotation-instructing operational unit, and wherein the shaft body of the toy top includes a buffer mechanism for absorbing an impact in an up-down direction.

2. A remote control toy top comprising the combination of:

a toy top; and a remote controller device that changes the operating mode of the toy top by remote control, wherein the toy top includes a toy top body provided with a motor whose forward and reverse rotational directions and rotational speed are controlled by control signals transmitted from the remote controller device, wherein the toy top includes a rotating shaft body that is rotatably supported at a bottom portion of the toy top body, the rotating shaft body rotating in conjunction with a motor shaft of the motor wherein the remote controller device includes a rotation-instructing operational unit that instructs forward and reverse rotation of the motor, wherein the remote controller device includes a change-instructing operational unit that instructs change of the rotational speed of the motor, the motor being rotated at a low speed when the rotation-instructing operational unit is operated, the motor being rotated at a high speed when the change-instructing operational unit is operated together with the rotation-instructing operational unit, and wherein the remote controller device is provided with a starter mechanism for providing an initial spin to the toy top.

3. A remote control toy top comprising the combination of:

a toy top;

a remote controller device that changes the operating mode of the toy top by remote control, wherein the toy top includes a toy top body provided with a motor whose forward and reverse rotational directions and rotational speed are controlled by control signals transmitted from the remote controller device, wherein the toy top includes a rotating shaft body that is rotatably supported at a bottom portion of the toy top body, the rotating shaft body rotating in conjunction with a motor shaft of the motor wherein the remote controller device includes a rotation-instructing operational unit that instructs forward and reverse rotation of the motor, wherein the remote controller device includes a change-instructing operational unit that instructs change of the rotational speed of the motor, the motor being rotated at a low speed when the rotation-instructing operational unit is operated, the motor being rotated at a high speed when the change-instructing operational unit is operated together with the rotation-instructing operational unit; and a rechargeable battery in the toy top and a pair of electrical contacts connected to the rechargeable battery that are accessible from an exterior of the toy top body for electrically recharging the rechargeable battery.

4. The remote control toy top according to claim 3 further including a pair of terminals on the remote controller device, a pair of electrical contacts on a housing member and a battery in the housing member electrically connected to the pair of electrical contacts, wherein the terminals on the remote controller device can be removably attached to the electrical contacts on the toy top to recharge the rechargeable battery.

5. A remote control toy top comprising the combination of:

a toy top; and a remote controller device that changes the operating mode of the toy top by remote control signals including a forward signal, a reverse signal and a speed change instructing signal, wherein the toy top includes a toy top body with a base member provided with a motor whose forward and reverse rotational directions and rotational speed are controlled by control signals transmitted from the remote controller device, a rotating shaft body that is rotatably supported at a bottom portion of the base member, the rotating shaft body rotating in conjunction with a motor shaft of the motor;

a receiving circuit unit is mounted in the base member for receiving the remote control signals, and a driver unit that drives the motor in a forward and reverse rotation upon receiving from the receiving circuit unit one of a forward control signal and a reverse control signal at a first rotational speed and drives the motor at a second rotational speed higher than the first speed when receiving the speed change instruction signal simultaneously with one of the forward and reverse control signals, and wherein the base member has a central opening to directly support the motor between a pair of housings for a pair of batteries connected to the receiving circuit unit and the driver unit.

6. The remote control toy top of claim 5 wherein the base member includes balancer members.

* * * * *